US005800291A

United States Patent [19]

Grover

[11] Patent Number: 5,800,291

[45] Date of Patent: Sep. 1, 1998

[54] BASKETBALL TRAINING APPARATUS

[75] Inventor: Tim S. Grover, Chicago, Ill.

[73] Assignee: Hoopmate, Inc., Chicago, Ill.

[21] Appl. No.: 632,816

[22] Filed: Apr. 16, 1996

Related U.S. Application Data

[63] Continuation-in-part of Ser. No. 487,114, Jun. 7, 1995, abandoned.

[51] Int. Cl.[6] ..... A63B 69/00

[52] U.S. Cl. ..... 473/447; 473/422

[58] Field of Search ..... 473/422, 446, 473/447, 448, 449, 450, 438, 416; 40/606, 607

[56] References Cited

U.S. PATENT DOCUMENTS

| | | | |
|---|---|---|---|
| D. 321,370 | 11/1991 | Curtis . | |
| 1,695,937 | 12/1928 | Welch . | |
| 2,932,516 | 4/1960 | Penner . | |
| 3,025,058 | 3/1962 | Brumfield . | |
| 3,171,626 | 3/1965 | Keats | 40/607 X |
| 3,552,749 | 1/1971 | Piggote . | |
| 3,602,504 | 8/1971 | Chapman et al. | 473/416 |
| 3,675,921 | 7/1972 | Meyers, Sr. . | |
| 3,716,234 | 2/1973 | Lancellotti . | |
| 3,868,108 | 2/1975 | Kirchner | 473/450 |
| 4,019,271 | 4/1977 | Latimer | 40/607 X |
| 4,481,729 | 11/1984 | Weiller | 40/607 X |
| 4,490,934 | 1/1985 | Knapp | 40/606 X |
| 4,989,862 | 2/1991 | Curtis . | |
| 5,160,138 | 11/1992 | Sanders . | |
| 5,485,993 | 1/1996 | Lipsett | 473/448 |
| 5,527,185 | 6/1996 | Davis | 473/438 |

FOREIGN PATENT DOCUMENTS

| | | | |
|---|---|---|---|
| 2708474 A1 | 2/1995 | France . | |
| 1509096 | 9/1989 | U.S.S.R. | 473/101 |
| 1535552 | 1/1990 | U.S.S.R. | 473/101 |

OTHER PUBLICATIONS

"Basketball Coaching and Training Aids 1989 School Mail Order Catalog," Korney Board Aids.Dec. 1988, p. 11, KBA Defensive Man.

*Primary Examiner*—Raleigh W. Chiu

*Attorney, Agent, or Firm*—Fitch, Even, Tabin & Flannery

[57] ABSTRACT

A basketball practice or training apparatus or assembly is provided including a floor mount and a vertical standard extending upwardly therefrom. Elongate arm shot obstructions are provided at the top of the standard and are removably mounted for changing the configuration of the shot obstruction if desired such as for practicing jump shots versus free throws. A guarding mechanism is also provided and is secured to the standard and includes a player-engaging portion in front of the standard and spaced above the floor mount. Preferably, the player-engaging portion is selectively movable transversely of the standard to adjust its position in front of the standard so as to allow an operator to manipulate the guarding mechanism for keeping the player-engaging portion close to the player even if they change their position relative to the standard. The guarding mechanism may also allow the operator to pivot the apparatus so as to angularly move the player-engaging portion and shot obstructions so they are maintained between the player and basket as the player moves about the standard for practicing various turnaround and face-up jump shots.

17 Claims, 8 Drawing Sheets

BASKETBALL TRAINING APPARATUS

CROSS-REFERENCE TO RELATED APPLICATION

This application is a continuation-in-part of U.S. patent application Ser. No. 08/487,114, filed on Jun. 7, 1995 and entitled "BASKETBALL TRAINING APPARATUS," now abandoned.

FIELD OF THE INVENTION

The invention relates to an apparatus for simulating a basketball defender and, more particularly, to a basketball defender apparatus including arms for shot obstructions and a guarding mechanism to vary the player position from the apparatus for practicing shots over the arm shot obstructions.

BACKGROUND OF THE INVENTION

Basketball is becoming an increasingly popular sport nationally and worldwide as evidenced by the number of different countries in which basketball is currently being played, including professional leagues having wide-spread fan support in those countries. As basketball's popularity grows, and the players' skills continually improve, there is a greater need for basketball training in which high level game-like conditions can be simulated or recreated. This is of particular importance as players move up from high school to college and then on to professional levels of competition where a coach or trainer does not have the physical abilities or characteristics, i.e., jumping ability or height, to present a formidable obstacle to a player such as when dribbling and practicing shots, as the player would typically encounter in a competitive basketball game against talented opposition.

While it is known to use obstacles between the players and the basket over which the player must shoot, these obstacles are oftentimes limited to the precise configuration in which they are assembled. Of course, this does not adequately recreate a game-like situation where a defender is attempting to steal the ball and constantly moving and readjusting their defensive position to present a more formidable obstacle between the player and basket and over which they must shoot. In this regard, coaches and trainers have been known to use broomsticks as a shot-blocking aid, thereby requiring the player to either jump higher or provide their shot with more arch or both to shoot the ball over the extended end of the broom. However, using a broom is undesirable in that it requires a coach or trainer to be present and to manipulate a broom which usually takes two hands for control and, thus, only presents a single obstacle which does not simulate a defender who can use both arms as a shot obstacle.

When shooting a basketball, it is common for the player to pick the ball up from their dribble and raise the ball up to a shooting position before executing a jump shot over a defender who is guarding them. Typically, a defender will reach out with their arms and hands in contact with the player with the ball to "hand check" the offensive player to maintain their defensive position between the ball and basket and to keep the offensive player dribbling the basketball in front of them. At the same time, the defender usually will be attempting to steal or strip the basketball as offensive players dribble and raise up for their jump shot while facing the defenders, herein called a "face-up jumper." Another common basketball shot is a turnaround jump shot where the player has his or her back to the defender and basket when picking up their dribble whereupon they then pivot while jumping to execute a shot over the defender. In this instance, the defender will typically have their hand or forearm in the back of the player to attempt to control their movements and keep them as far away as possible from the basket, forcing them to take a longer turnaround jump shot than they would like. As the player is not facing the basket, typically the further away they are from the basket the lower their chances are of scoring with a turnaround jumper. Prior devices used as shot obstacles for basketball training do not address this aspect of defense where the defender utilizes their outstretched arms and hands in an attempt to either steal the ball or hand check or push on the player's back. Thus, there is a need for an apparatus which provides a shot obstruction while also simulating the outstretched arms and hands of a defender when attempting to steal or strip the ball such as when taking a face-up jumper off the dribble or a turnaround jump shot, as described above.

Another limitation of the prior art basketball training devices is that the shot obstructions utilized are not readily removable from the apparatus without substantial disassembly work and time. Examples of such devices are shown in U.S. Pat. Nos. 3,675,921; 4,989,862; and 5,160,138. Easy removal and interchangeability of obstructions is desirable so as to allow the number and positioning of these obstructions to be varied. In this manner, the training apparatus can be utilized with different types and configurations of shot obstructions to simulate different game situations, and more particularly different defenders.

SUMMARY OF THE INVENTION

In accordance with the invention, basketball training or practice apparatus or assembly is provided for more closely simulating a basketball defender by way of the provision of a shot obstruction mounted to a vertical standard over which a shot with a basketball can be taken by a player and a guarding mechanism secured to the standard and having a player-engaging portion spaced above the floor mount. The guarding mechanism can be movable transversely relative to the standard to adjust the position of the player-engaging portion in front of the standard and shot obstruction for creating a minimum distance the player is required to be from the standard when engaged with the guarding mechanism portion. The guarding mechanism portion can serve dual roles with the role depending on the shot being practiced by the player. For example, if the player is facing the defender apparatus and practicing a face-up jumpers off of their dribble, the player-engaging portion requires that the player avoid contact therewith when bringing the ball up to a shooting position simulating the outstretched arms of a player when trying to steal or strip the ball as the player brings the ball up for a shot. Also, the player engaging portion is effective in simulating the defender's hand or arm usually placed in their back when they are preparing to take a turnaround jump shot. In this manner, the basketball defender apparatus herein more accurately simulates the conditions encountered during a game situation such as when a defender tries to strip the ball when a player executes a face-up jumper or tries to keep the offensive player away from the basket before they can execute a turnaround jumper.

In one form, the guarding mechanism can be moved to position the player-engaging portion at a predetermined, substantially fixed position in front of the standard. This allows the player to practice their turnaround jump shots without a trainer or coach being present, while still providing the simulated feel of a defender's hand or arm on their back for practicing turnaround jumpers and requiring the player to keep the ball away from the player-engaging portion when practicing face-up jumpers.

Preferably, the guarding mechanism can be selectively moved transversely relative to the standard by an operator to vary the position of the position of the player engaging portion in front of the standard. Selective movement of the player engaging portion by an operator allows a coach or trainer to more precisely simulate a defender, such as when the offensive player is moving so as to maintain either close positioning relative to a facing player or substantially constant contact with the back of an offensive player with respect to a player who has their back to the basket by moving the player-engaging portion accordingly. To more readily allow the operator to maneuver the guarding mechanism, the basketball defender apparatus includes a floor mount which can have an upper platform surface behind the standard on which the operator can stand.

For allowing an offensive player to move around while still allowing the defender apparatus herein to closely simulate a defender, the basketball defender apparatus includes a standard which defines a vertical axis substantially perpendicular to the floor surface with the standard being rotatable about its axis for angular displacement of the player-engaging portion about the standard. Preferably, the guarding mechanism includes handle controls for allowing an operator to transversely and angularly move the guarding mechanism and player-engaging portion. The shot obstruction can be mounted at the top of the standard so that rotating the standard about its axis with the controls causes the shot obstruction to rotate therewith. Thus, by allowing an operator to pivot the standard, the present basketball defender apparatus more closely simulates a defender as when the offensive player changes their position relative to the basket so that the defender apparatus can also pivot and move to maintain its position between the offensive player and basket. This is a significant improvement over prior basketball training devices where the player had to substantially stay in one location while practicing their shots.

In another form of the invention, the basketball training apparatus includes a carriage mounted to the standard and which is slidable thereon to a plurality of different vertical positions along the standard. The guarding mechanism having the player-engaging portion in front of the standard includes a slidable shaft connected to the player-engaging portion which is slidable through the carriage for moving the player-engaging portion into contact with the player at a variety of different distances from the standard. By the provision of a sliding carriage, the height of the player-engaging portion can be varied so that it is positioned to contact players of various heights at approximately the same portion of their back.

In yet another form of the invention, a basketball practice assembly for defending shots taken by a player is provided with the assembly including a base for support thereof and a telescoping vertical standard having a lower section mounted to the base and an upper section with the sections adjustably secured to each other for varying the height of the upper section over the lower section. Arm mounts are attached to the top of the upper section and a plurality of elongate arms are each removably secured to respective ones of the arm mounts for extending upwardly from the top of the standard to provide a shot obstruction to a player practicing basketball shots over the arms such that the number and position of the arms can be varied for providing different configurations of shot obstructions to the practicing player. In this manner, the degree of difficulty of the basketball practice assembly for shooting over the arms can be varied according to the skill level and physical characteristics of the practicing offensive player.

In a preferred form, the arms have an enlarged portion at the ends distal from the standard with the enlarged portion being configured to one of (1) obstruct a player's vision through the enlarged portion for practicing jump shots over the enlarged portion, and (2) allow a player to see clearly through the enlarged portion for practicing free throws over at least one of the enlarged portions. Thus, the basketball practice assembly can be utilized not only for practicing jump shots as when the enlarged portions obstruct a player's vision but for use in perfecting a player's free throw shot as when the enlarged portion allows a substantially clear view therethrough by requiring a player to provide sufficient arch to the free throw shot so that it clears the enlarged portion. This is desirable as typically a "line drive" or flat free throw shot has a lower chance of success than a more arched shot.

BRIEF DESCRIPTION OF THE DRAWINGS

These and other objects of the present invention will be readily understood upon consideration of the following detailed description and attached drawings, wherein.

DETAILED DESCRIPTION OF THE PREFERRED EMBODIMENT

Figure 1:
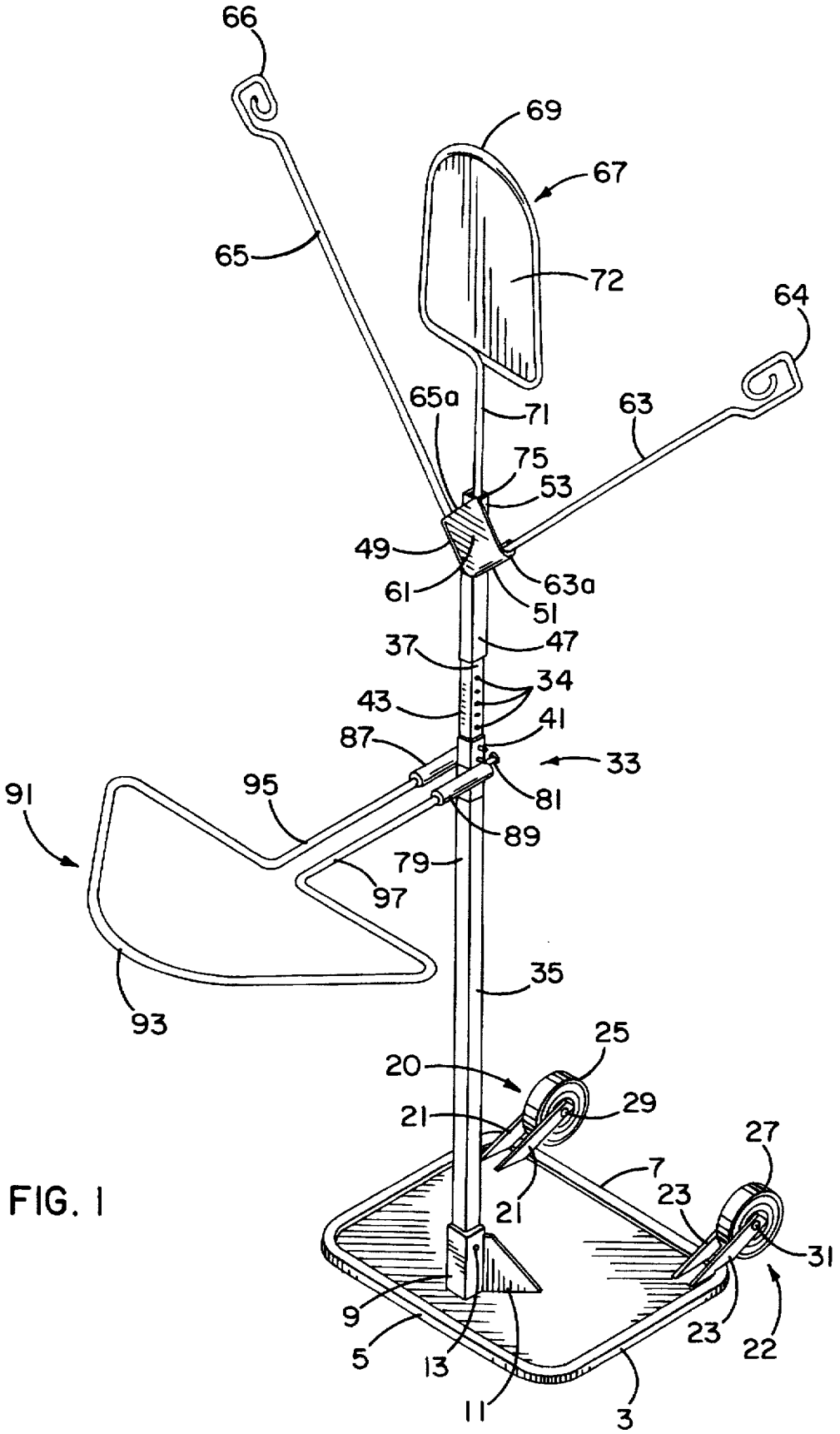
FIG. 1 is a perspective view of the assembled basketball defender apparatus according to the present invention, including the movable base, height-adjustable central support structure having head and arm members extending therefrom and a horizontal spacing member.

Referring more specifically to the drawings, the basketball training apparatus of the present invention includes a base 1, which supports a height-adjustable central support structure 33 to which arm members 63 and 65 and head member 67 are attached by means of a vertical carriage 45, secured to the upper end of the central support structure. A spacing member 91 projects outwardly from the central support structure and is releasably secured thereto by means of horizontal carriage 77 and adjacent shafts 95 and 97.

Figure 2:
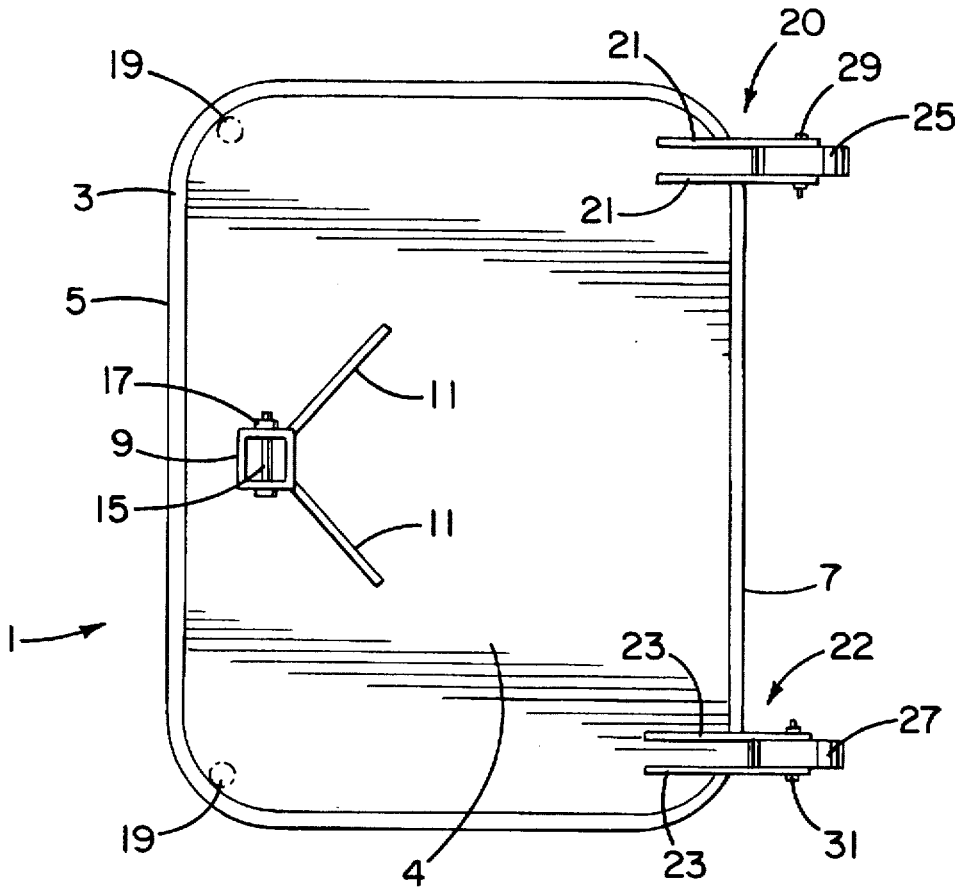
FIG. 2 is a plan view of the base including a pair of wheels and a support bracket.
Figure 3:
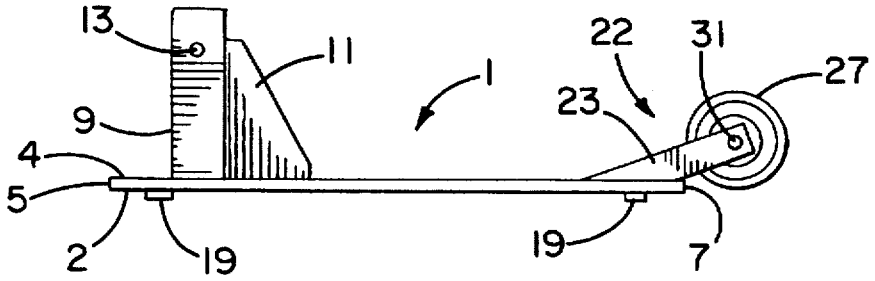
FIG. 3 is a side elevational view of the base including the wheels and support bracket.

Various views of the base 1 are illustrated in FIGS. 1, 2 and 3. The base 1 is substantially flat and is bordered by an outer rim 3. The base includes a front end 5 and a rear end 7 opposite the front end. A support bracket 9 is secured to the base 1 and includes holes 13 through two of its opposite sides. The support bracket 9 may be reinforced by support fins 11, which extend at an angle to each other from the support bracket 9 towards the rear end 7 of the base 1. The lower mast 35 of the central support structure 33 may be releasably secured to the support bracket 9 by means of bolt 15 threaded through holes 13 in the support bracket and the lower mast and held in place by a retaining pin 17, as shown in FIG. 2.

The base 1 should have sufficient weight to provide stability to the training apparatus when the apparatus is bumped by a player or hit by a ball during use. Preferably, the base is substantially flat and of minimal thickness so as to minimize the risk of injury to a basketball player's feet, ankles, or knees as the player moves about the base. A steel base plate of approximately ¼ inch in thickness and weighing approximately 32 pounds has been found to provide adequate stability in one embodiment of the invention in which the central support structure and associated extension members extend in excess of 12 feet above the base. However, bases of various other dimensions could be employed, depending on the size and weight of the central support structure and extensions employed in a given embodiment of the invention; however, it may be preferable in many designs to position the support bracket 9 closer to the front end 5 of the base 1 than to the back end 7 of the base so that the base is biased to provide added stability to prevent the apparatus from tipping when a force is applied against the spacing member 91 shown in FIG. 1 and described more fully below.

Although not required, slide resistant cushioning material may be attached to the underside 2 of the base 1 to help prevent the base from sliding during use or scratching the floor surface Pads such as pads 19, shown in FIGS. 2 and 3, may be employed for this purpose; and they are preferably formed from a soft but resilient material, such as rubber.

Also shown in FIGS. 1–3 are wheel assemblies 20 and 22, which allow the base 1 to be easily rolled on or off the court or repositioned on the court as desired during a training session. The wheel assemblies 20 and 22 include wheel brackets 21 and 23, respectively secured to the upper side 4 of the base 1 and extending outwardly past the rear end 7 of the base 1. Wheel 25 is rotatably mounted within wheel bracket 21 by means of axle 29; whereas wheel 27 is rotatably mounted within wheel bracket 23 by means of axle 31. As shown in FIG. 3, the wheel brackets 21 and 23 and wheels 25 and 27 are preferably positioned and sized so as to provide a clearance between the outer circumference of the wheels and the floor surface when the base 1 is resting in a horizontal, in-use position, thereby maintaining complete contact between the underside of the base (or any padding attached thereto) and floor surface to prevent the defender apparatus from rolling or otherwise moving during use. The apparatus may be readily repositioned by simply tipping it back slightly towards the rear end 7 of base 1 to engage the wheels 25 and 27 with the floor surface and allow the apparatus to be rolled to the next desired location.

Details of the central support structure 33 of the training apparatus of the invention are shown in FIG. 1. The central support structure 33 may include a lower mast 35 and an upper mast 37, the upper mast sized to slidably engage the lower mast to provide a telescoping height adjustment means for the central support structure. As described above, the lower mast 35 is secured to the base 1 by means of support bracket 9. The upper mast 37 fits inside the lower mast 35 and contains multiple spaced adjustment holes 39 which allow the upper mast 37 to be releasably secured to the lower mast at various positions by means of frictional adjustment screw 41. In one embodiment of the invention, the lower and upper masts are formed from aluminum tubing with the lower mast extending approximately 6 feet in length and the upper mast extending approximately 6.5 feet in length. By means of the frictional adjustment screw 41, the height of the central support structure can therefore be readily adjusted to simulate basketball defenders of various heights, arm reach, and jumping abilities. Furthermore, the upper and lower masts may be easily disassembled for transporting or storing the defender apparatus. As shown in FIG. 1, the upper and lower masts may also include demarcations 43 indicating the height of the central support structure or the entire assembly, including head or arm extensions as desired.

Although the central support structure 33 shown in FIG. 1 includes two mast portions, a single mast portion could be used and the height of the apparatus adjusted by means of using head and arm extension of differing lengths. Alternatively, more than two telescoping masts could be employed to provide the desired height adjustability of the defender apparatus.

Figure 4:
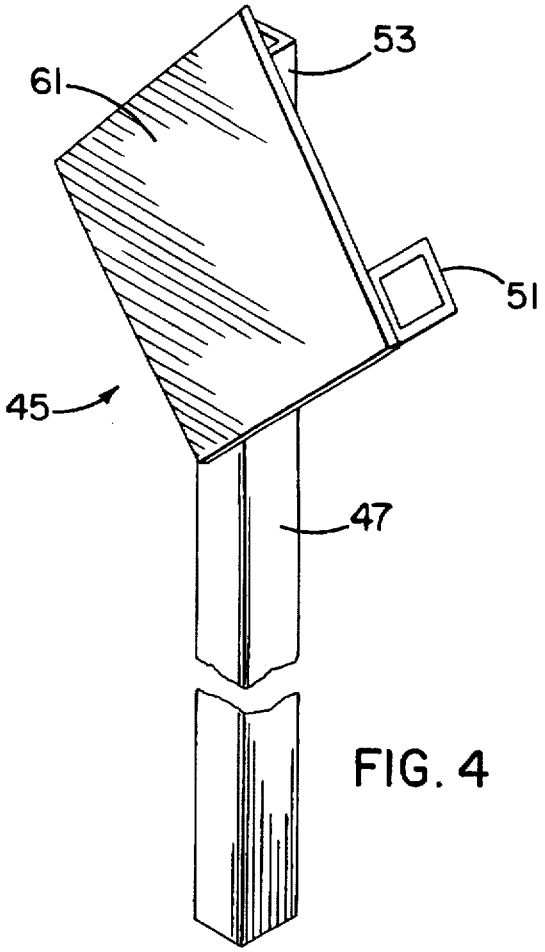
FIG. 4 is a perspective view of a vertical carriage including support sleeves for the extension members and a breast plate.
Figure 5:
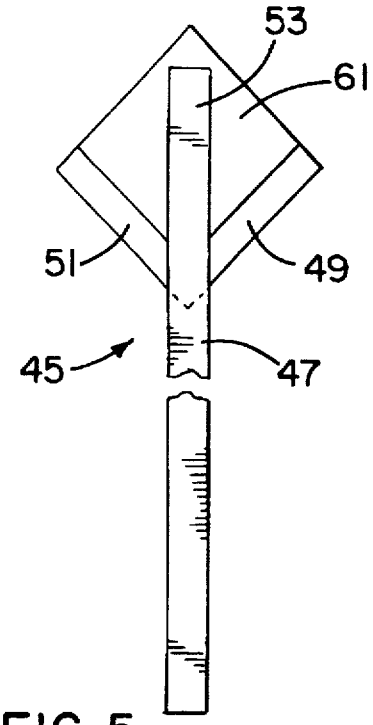
FIG. 5 is a rear elevational view of the vertical carriage of FIG. 4 showing additional details of the support sleeves.

A removable vertical carriage 45, such as the one shown in FIGS. 4 and 5, is provided to allow various extension members to be connected to the upper end of the central support structure 33 in various directions to provide a variety of shooting obstructions to the practicing player. The vertical carriage 45 includes a lower stem 47, sized to engage the upper end of upper mast 37 and rest thereon. The lower stem 47 extends into angled arm sleeves 49 and 51 and head sleeve 53 as shown in FIG. 5. A breast plate 61 may be attached to the vertical carriage for including various indicia as desired for marketing or other purposes. Arm member 63 extends at one end into hand member 64 and includes tabs 63*a* at its other end, sized to frictionally engage the arm sleeve 51. Similarly, arm member 65 extends at one end into hand member 66 and includes tabs 65*a* at its other end, sized to frictionally engage arm sleeve 49. Arm members of various other shapes and sizes than the ones shown herein may be employed in the present invention as desired. Additionally, jointed arm members could be employed to simulate movement from the elbow of the defender.

Figure 7A:
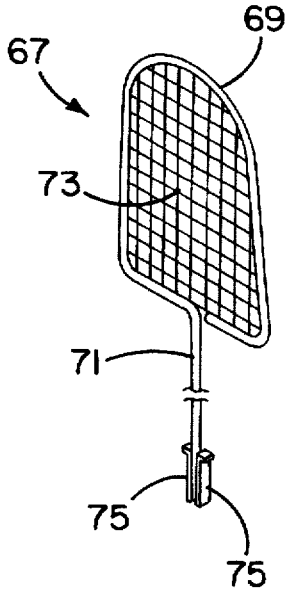
FIG. 7A is a perspective view of a looped head member containing a mesh screen.
Figure 7:
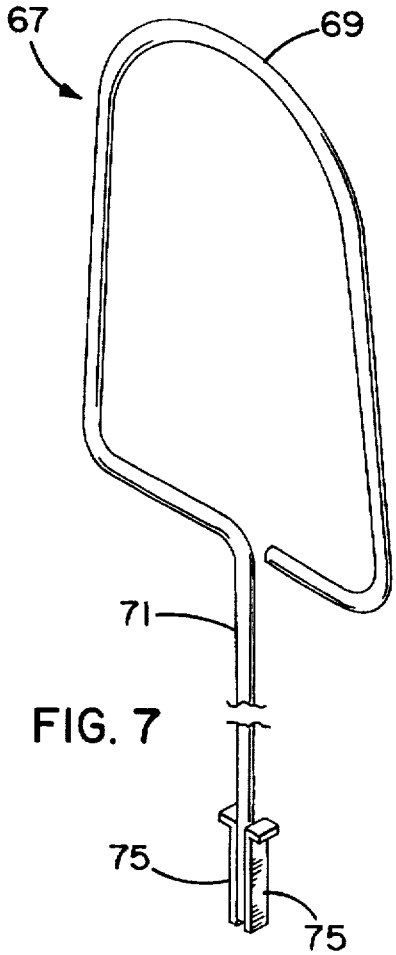
FIG. 7 is a perspective view of a looped head member.
Figure 10:
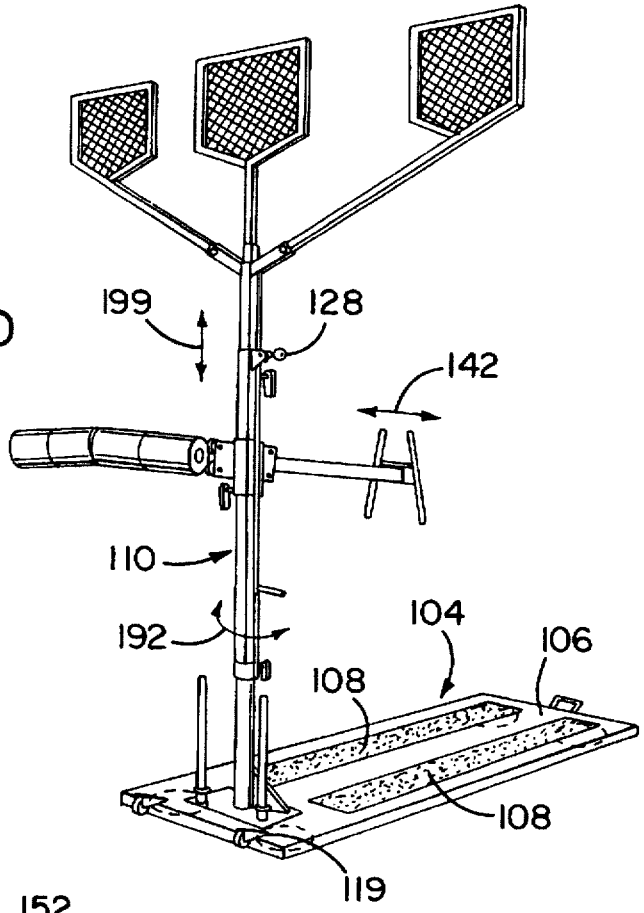
FIG. 10 is a perspective view of another form of the basketball defender apparatus including a floor mount, a standard having a guarding mechanism thereon and shot obstructions mounted at the top of the standard.

As shown in FIG. 7, head member 67 includes a looped portion 69 and a neck portion 71 extending below the looped portion and containing tabs 75 sized to frictionally engage head sleeve 53 of the vertical carriage 45. The head, arm and hand members are preferably formed from a lightweight material of suitable strength and rigidity, such as aluminum tubing. As shown in FIG. 1, the head member may include a solid face plate 72 to provide the maximum amount of obstruction to the player from the head member. Alternatively, the head member may consist of an open loop as shown in FIG. 7 or may be covered with a mesh screen 73 as shown in FIG. 7A. The mesh screen 73 allows the practicing player to see through the loop portion of the head member while still partially obstructing the player's vision to the basket, which may be helpful in simulating a temporary obstruction, such as that caused by a moving defender.

As is evident from the foregoing description of the vertical carriage and the extension members, the extension members may be easily removed from and connected to the vertical carriage so that a variety of extensions of different sizes and shapes may be employed to simulate different defender body types and adjust the degree of difficulty of shooting over and around the defender apparatus. The apparatus may be used without one or more of the arm members or the head member as desired or, alternatively, additional arm members or head members may be added to simulate multiple defenders or the various possible body positions of a single defender. This can be accomplished by utilizing a modified vertical carriage containing additional sleeves for holding any number of desired extension members and any desired direction.

Figure 8:
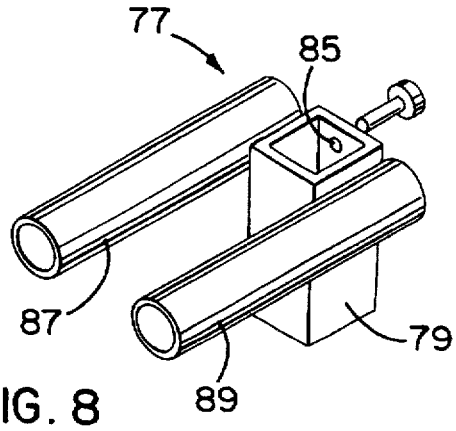
FIG. 8 is a perspective view of a horizontal carriage for securing the spacing member to the central support structure.
Figure 6:
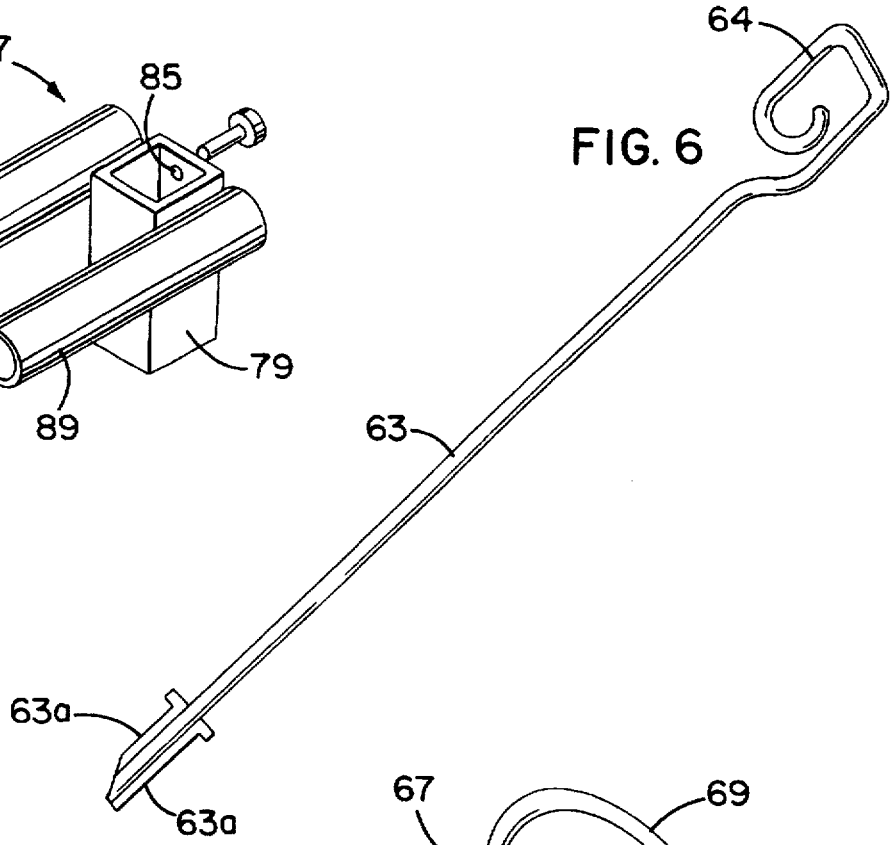
FIG. 6 is a perspective view of an arm member having a hand member at one end.

As shown in FIG. 1, the apparatus of the present invention also preferably includes a spacing member 91 mounted to the central support structure 33 and extending outwardly from it to provide an added obstruction separate from the arm and head shooting obstructions provided by the extension members, allowing a player to practice proper court positioning relative to a defensive player. The spacing member 91 may be releasably secured to the central support structure 33 by means of a horizontal carriage 77, which is shown in more detail in FIG. 8. The horizontal carriage 77 includes a vertical member 79 which is slidably mounted about lower mast 35 and secured thereto by means of frictional adjustment screw 81 which engages the outer surface of the lower mast through hole 85 in the vertical member 79. Horizontal sleeves 87 and 89 are attached at opposite sides of the vertical member 79 and extend outwardly from it towards the side of the apparatus which contains the front end 5 of the base 1. The spacing member 91 contains an arcuate portion 93 which extends into adjacent shafts 95 and 97; which are sized to frictionally engage the inner surfaces or horizontal sleeves 87 and 89, respectively. To facilitate the engagement between the adjacent shafts 95 and 97 of the spacing member and horizontal sleeves of the carriage, the adjacent shafts may be slightly skewed relative to each other and the horizontal sleeves positioned substantially parallel to each other so that the tension force in the shafts 95 and 97 presses the shafts securely against the inner surfaces of horizontal sleeves 87 and 89. The spacing member 91 may then be adjusted inward and outward relative to the central support structure by manually squeezing the adjacent shafts 95 and 97 together to release the tension between the shafts and the horizontal sleeves and allow the shafts to be translated towards or away from the central support structure as desired. Alternatively, the horizontal sleeves could be slightly skewed with the adjacent shafts of the spacing member being substantially parallel to provide the desired frictional engagement between the shafts and the horizontal sleeves. The horizontal carriage may be fabricated from steel tubing or any other material of suitable strength. The spacing member 93 is preferably formed from a strong but lightweight and slightly flexible material, such as aluminum tubing.

Thus, the horizontal carriage 77 allows the spacing member 91 to be adjusted to various heights along the lower mast of the central support structure 33 and to be spaced at various distances from the central support structure. The spacing member provides the advantage of inhibiting the practicing player from positioning his or her body too close to the defender apparatus. Thus, a player may practice "backing in" to a defender and dribbling, passing or shooting the ball from that position by turning his or her back to the defender apparatus and moving towards the defender apparatus until contact is made with the spacing member. When using the defender apparatus for this purpose, the spacing member provides the practicing player with the simulated feeling of the presence of a defensive player behind the practicing player. In addition, while skewing of the shafts 95 and 97 provides relatively secure engagement with the sleeves 87 and 89, respectively, the spacing member 91 is not so rigidly fixed in place relative to the central support structure 33 so as to cause harm or injury to a player who contacts the spacing member 91, such as may occur when a player backs into the arcuate portion 93 of the member 91 when practicing a turn-around jump shot. In this manner, there is some give to the spacing member 91 which also more accurately simulates a "live" opponent than if the spacing member 91 was rigidly secured relative to the support 33. When practicing dribbling, passing or shooting the ball while facing the defender apparatus, the spacing bar allows the player to practice, keeping the ball away from the potential span of the outstretched horizontal reach of a defensive player. Thus, the apparatus of the invention, by means of the spacing member and the various possible extension members extending above the central support structure, may simultaneously simulate both the horizontal out-stretched reach of a defensive player as well as the vertical reach of one or more defenders to more accurately simulate the obstructive effect of an actual defensive player.

Figure 9:
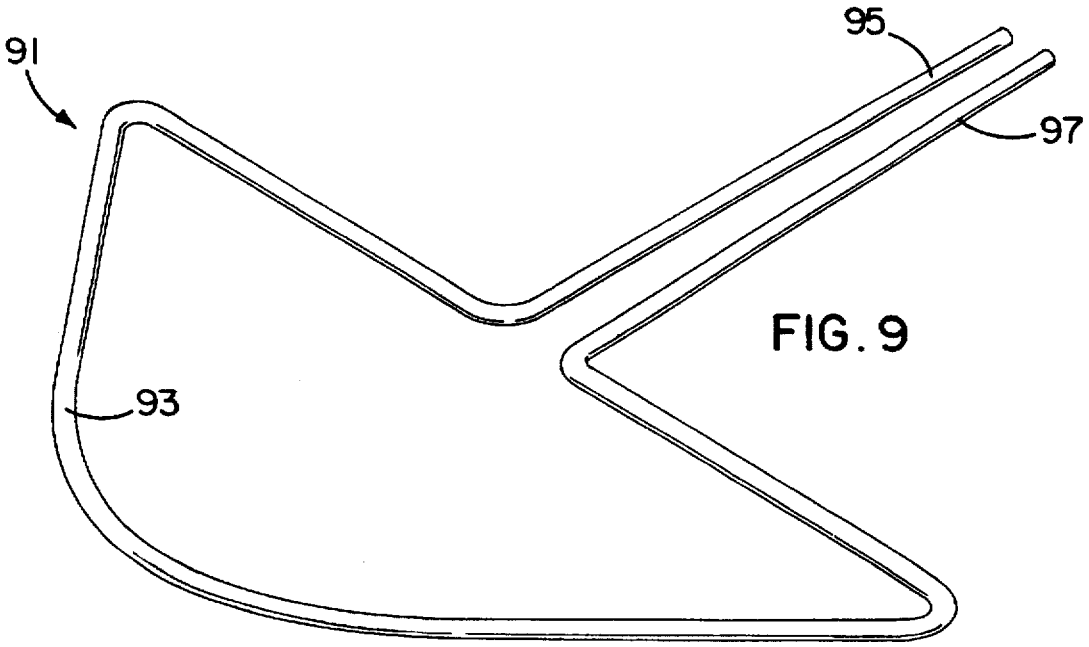
FIG. 9 is a perspective view of the spacing member including an arcuate portion and a pair of adjacent shafts.

Although the spacing member 91 shown in FIGS. 1 and 9 consists of an open loop structure, various other means for providing the desired spacing between the practicing player and the central support structure 33 of the present invention may be employed within the scope of the invention. For example, the spacing member 91 may be formed of a solid planar material rather than as an open loop. Further, the shape of the spacing member may be modified as desired to define any desired region within which the practicing player will be inhibited from positioning his or her body or placing the basketball. The arc-shaped spacing member shown in FIG. 1 simulates the typical radial span of a defender's horizontally out-stretched arms. However, a rectangularly shaped spacing member could be used or a circular spacing member spanning in all directions around the central support structure could be employed.

In general, the apparatus of the present invention may be fabricated from various other materials other than those described herein, such as a durable plastic material or other suitable material.

Another form of a basketball defender apparatus or assembly 100 is illustrated in FIGS. 10–15. The apparatus 100 is similar in many respects to the basketball training apparatus described above with respect to FIGS. 1—9 except that it allows an operator 102 to manipulate the apparatus 100 for improved simulation of a basketball defender.

More particularly, the basketball training or practice assembly or apparatus 100 includes a floor mount base 104 having an upper platform surface 106 provided with two strips of a non-slip material 108 thereon on which the operator 102 can stand. A vertical standard 110 extends upwardly from the base 104 and includes a lower mast section 112 and an upper mast section 114. The lower mast section 112 is mounted to the base 104 via a hollow mounting stem 116 attached to flat base plate 118. Between the stem 116 and plate 118, gussets 119 can be attached to help the stem 116 and base 104 support the weight of standard 110 and any impacts received from a player as more fully described herein. The base plate 118 can be secured by bolting or the like to the forward end of the base 104. By the provision of a base 104 which extends a substantial distance rearwardly from the standard 110, the apparatus 100 herein is provided with additional stability. By way of example, the base 104 can have a width of approximately two feet and a length of six feet. For even greater stability, a pair of weight tree rods 120 and 122 can be attached to the base plate 118 on either side of the mounting stem 116 for receipt of weights 124 thereon. This is particularly valuable when large and heavy players such as centers and power forwards are using the apparatus 100 without an operator 102 on platform 106, as will be apparent for reasons discusses hereinafter.

The upper and lower mast sections 112 and 114 are adjustably secured to each other with the upper mast 114 telescoping into the lower mast 112. The upper mast 114 has a plurality of vertically spaced apertures 126, such as by 6 inches with height indicia to indicate the height of the apparatus 100, and the lower mast 112 includes a spring biased height adjusting pin 128 which when pulled allows the upper mast section 114 to be raised or lowered relative to the lower mast section 112 to adjust the height of the upper section 114 over the lower section 112. When the upper mast section 114 is at its desired height, the height adjusting pin 128 can be released into one of the aligned apertures 126 to fix the height of the upper mast section 114.

A guarding mechanism 130 is secured to the vertical standard 110 and includes a player-engaging portion 132 positioned in front of the vertical standard 110. The player-engaging portion 132 can be a straight mounting rod 134 having cushion material 136 provided therearound to allow cushioned impact with a player 138 and thereby minimize the risk of injury to the player 138 when engaging the cushioned player-engaging portion 132. Manifestly, other configurations for the engaging portion 132 can be utilized, such as the previously-described arcuate form.

The guarding mechanism 130 and, particularly the player-engaging portion 132, are movable transversely relative to the standard 110 to adjust the position of the player-engaging portion 132 in front of the standard 110. In this manner, there is created a minimum distance from the standard a player must be when dribbling in front of the standard 110 and/or executing a shot over shot obstructions 140, which in the illustrated embodiment, include first, second and third elongate arm members **140*a*–140*c* removably mounted at the top of the upper mast section 114. For moving the player-engaging portion 136 transversely in a fore and aft direction relative to the standard 110 as indicated by arrows 142 in FIG. 10, the mounting rod 134 is attached to a shaft 144 at its forward end and a pair of control handles 146** formed at its rear end.

The player-engaging portion 132 can be moved to a predetermined desired position in front of the standard 110 and fixed thereat to allow a player 138 to utilize the apparatus 110 without a trainer or coach. The player 138 can back into the portion 132 and practice their turnaround jump shot over the obstructions 140. Therefore, the previously described stability enhancing features are of particular value so that the player 138 can back into the portion 132 with a fairly good amount of force as they may have to in a game situation before picking up their dribble and executing their turnaround jump shot. With the stability of the apparatus 100 herein, a large player 138 can back in without fear of causing the apparatus 100 to tip over and fall. In addition, a player 138 facing the standard 110 can approach the portion 132 so they are relatively close thereto while dribbling and practice their face-up jumpers while attempting to avoid the portion 132 when picking up their dribble and raising the ball to a shooting position. This encourages the player 138 to protect the ball from defenders who are trying to strip the ball as it is brought up for a shot.

Figure 13:
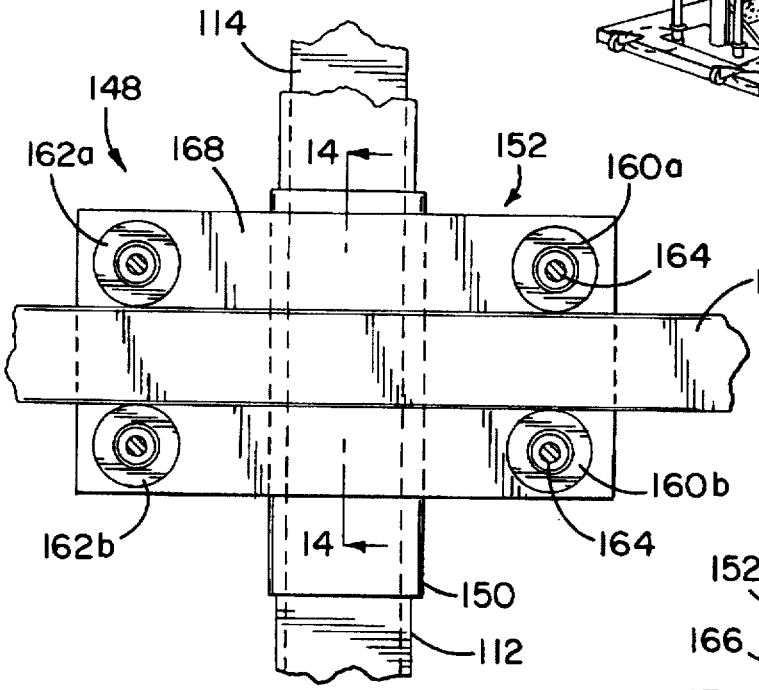
FIG. 13 is an enlarged side elevational view of the interior of a carriage for the guarding mechanism showing the shaft of the guarding mechanism and roller bearings therefor.
Figure 14:
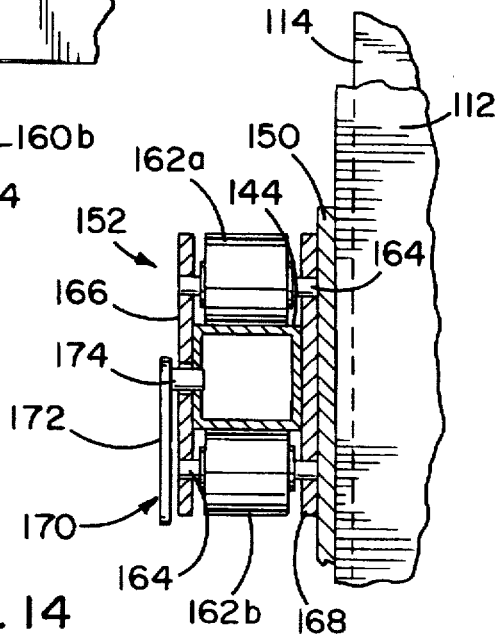
FIG. 14 is a sectional view taken along line 14—14 of FIG. 13 showing upper and lower rollers for rolling engagement with the guarding mechanism shaft.
Figure 11:
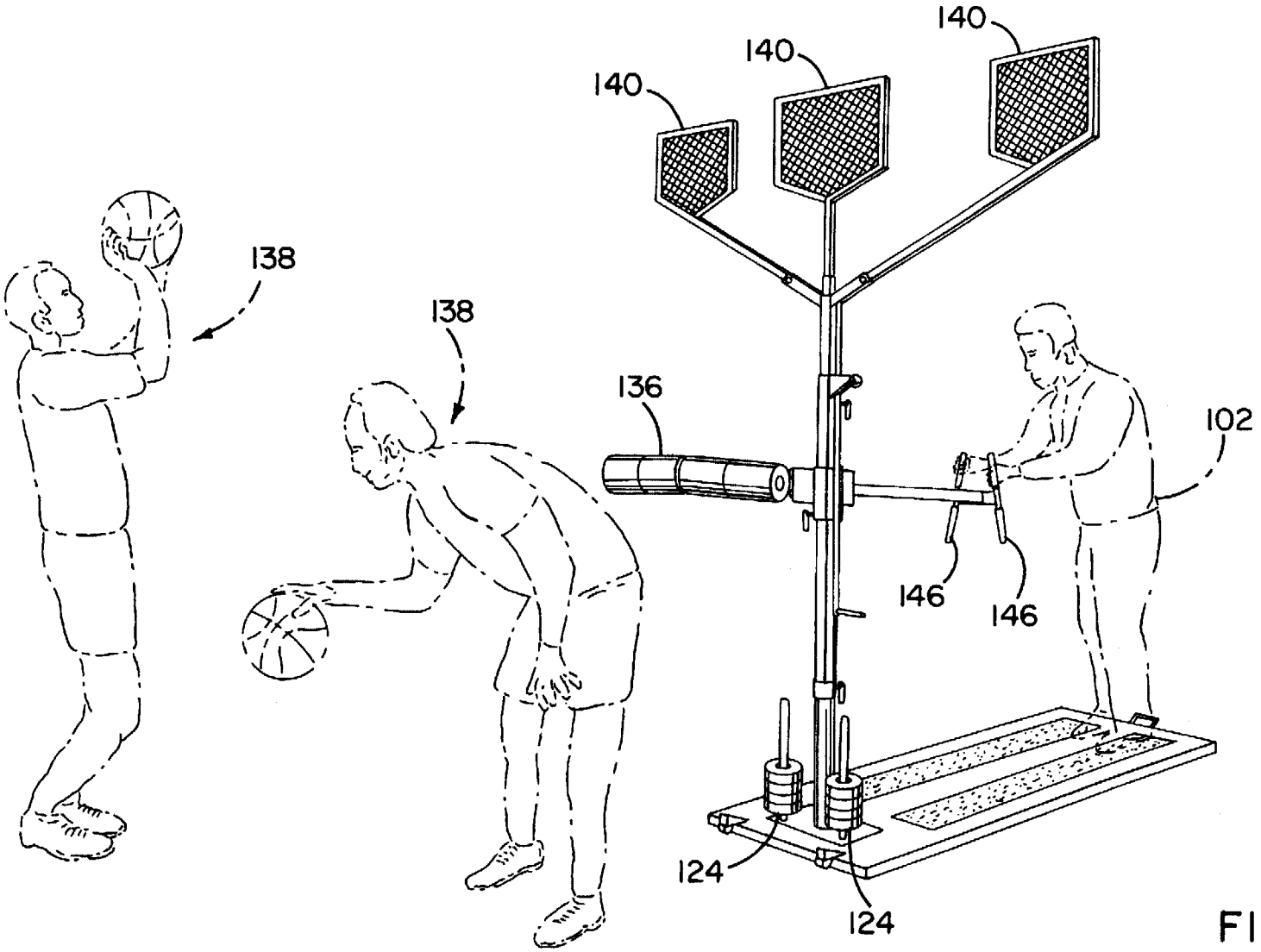
FIG. 11 is a perspective view of the basketball defender apparatus of FIG. 10 showing an operator standing on the platform surface of the floor mount for manipulating the guarding mechanism and a player-engaging portion thereof relative to a player practicing a turnaround jumper over the shot obstructions.
Figure 12:
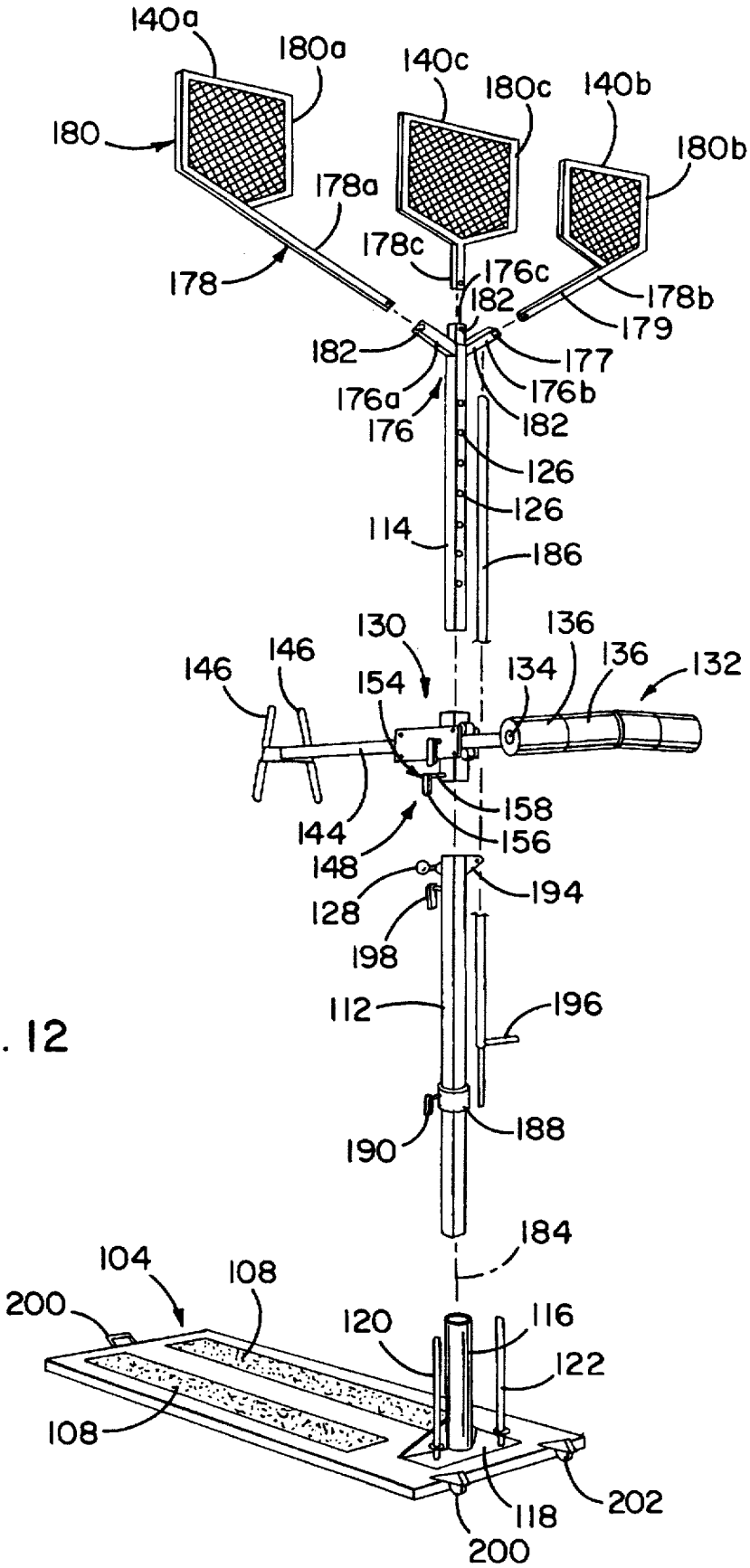
FIG. 12 is an exploded view of the basketball defender apparatus of FIG. 10 showing the upper and lower sections of the standard with the shot obstruction arms removed from their mounts at the top of the standard upper section.
Figure 15:
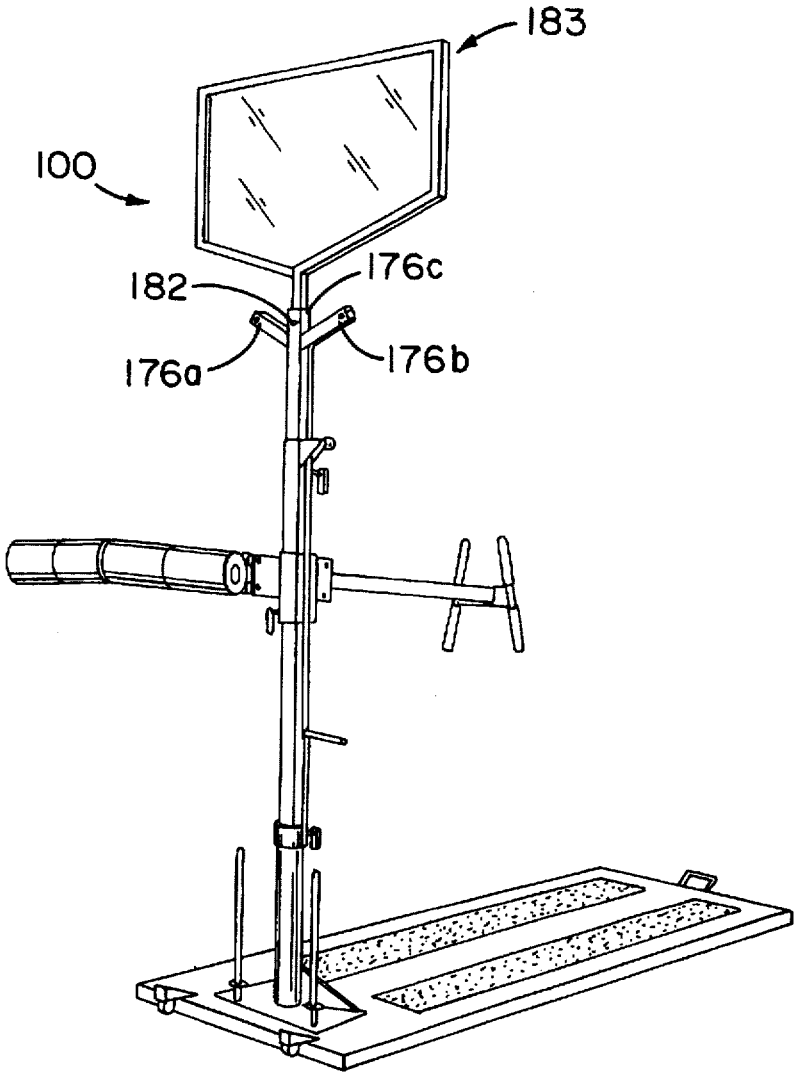
FIG. 15 is a perspective view of the basketball defender apparatus similar to FIG. 10 with the shot obstructions thereof removed and replaced with a central arm having an enlarged portion configured to allow a player to see therethrough.

A carriage 148 for the guarding mechanism 130 is provided for securing the shaft 144 to the standard 110. More specifically, the carriage 148 includes a vertical sleeve portion 150 and a bearing housing 152, as best seen in FIGS. 13 and 14. The sleeve portion 150 has a bore formed therethrough which is sized to slide over the lower mast section 112. A friction lock 154 is mounted to the sleeve portion 150 and includes a lever portion 156 and a pin portion 158 such that with the lever 156 pivoted down to its locked position, the pin 158 will frictionally engage the lower mast section 112 providing a friction force sufficient to lock the carriage 148 in place on the lower mast section 112. To change the vertical position of the carriage 148 and thus the height of the player-engaging portion 132 over the base 104 and floor surface on which it rests, the lever 156 is pivoted upwardly to its unlocked position, pulling the pin 158 out of frictional engagement with the lower mast section 112. Manifestly, other lock devices can be utilized for allowing the carriage 148 to slide along the standard 110 and be locked in a specific vertical position thereon. Thus, the carriage 148 can be slid to the appropriate location on the mast section 112 depending on the height of the player using the apparatus 100, thereby allowing the guarding mechanism 130 to be effectively utilized with players having a wide range of heights. In this manner, the player engaging portion 132 can be set at a height, for example, for players practicing their turnaround jumpers, so that it hits different heights of players at approximately the same position on their backs.

For moving the guarding mechanism 130 transversely relative to the standard 110 in the direction of arrows 142, the shaft 144 extends through the bearing housing 152 for sliding movement on bearings mounted in the housing portion 152. More specifically, the bearings include a set of front upper and lower rollers **160*a* and 160*b* and a set of rear upper and lower rollers 162*a* and 162*b* with the roller set 160 mounted to the bearing housing 152 in front of the standard 110 and the roller set 162 mounted rearwardly of the standard 110 in the bearing housing 152. The rollers 160 ad 162 are mounted on axles 164 which extend from the outer side 166 to the inner side 168 of the housing 152 with the inner side 168 being secured, such as by welding, to the sleeve portion 150**.

To move the fore and aft position of the player engaging portion 132, a friction lock 170 similar to lock 154 is provided on bearing housing 152 and is opened by pivoting the lever portion 172 thereof upward to its unlocked position thereby withdrawing its friction pin 174 from its frictional locking engagement with the shaft 144 and allowing an operator 102 to grip the handles 146 and exert either a push or a pull thereon causing the shaft 144 to rollingly slide along the rollers 160 and 162 through the bearing housing 152 in the direction of arrows 142. To lock the position of the player-engaging portion 132, the operator 102 simply positions the player-engaging portions 132 at its desired location and pivots the lever 172 down to its locked position, as depicted in FIG. 14. Similar to the lock 154, other locks can be utilized for locking the shaft 144 in housing 152 and releasing the shaft 144 for sliding movement through the bearing housing 152. By allowing the operator 102 to selectively move the player-engaging portion 132, the apparatus 100 can be utilized to more accurately simulate game conditions so that if the offensive player 138 moves towards or away from the standard 110 to change their distance from the standard 110 in front thereof, the operator 102 can adjust the position of the portion 132 accordingly. Therefore, if the player 138 is practicing turnaround jump shots and changing their position in front of the standard 110 or leaning in or fading away as they jump, the operator 102 can substantially maintain the player-engaging portion 132 in contact with the back of the player 138 without significantly altering the force felt by the player 138 by pulling or pushing on the handles 146. Also, if a player 138 is practicing face-up jumpers off their dribble and changing their position in front of the standard 110, the operator 102 can likewise substantially maintain the portion 132 near the player 138 so as to require them to keep their dribble low and protect the ball when raising up for the shot.

The upper mast section 114 of basketball training assembly 100 is provided with arm mounts 176 extending from substantially the top thereof and including mounting apertures 177 formed therein. More particularly, arm mount 176*a* and arm mount 176*b* extend upwardly and outwardly from opposite sides at the top of the upper mast section 114 at an angle thereto with the angles of the arm mounts 176*a* and 176*b* with respect to the vertical mast section 114 being substantially equal. The arm mount 176*c* can extend substantially straight upwardly from the mast section 114. Preferably, the shot obstructions 140 each include an elongate arm portion 178 and an enlarged portion 180 at the end of the arm portion 178 distal from the standard 110 and having a mesh configuration to obstruct a player's view through the enlarged portions 180 when shooting thereover. The arm portions 178*a* and 178*b* with their associated enlarged portions 180*a* and 180*b* can be identical in sizing with the arm portion 178*c* being shorter than the arm portions 178*a* and 178*b* so that the top of the enlarged portions 180*a*–180*c* are all at the same height when the arms 178 are assembled in their respective mounts 176.

For mounting the arm portion 178 in their respective arm mounts 176, the arm portions 178 are provided with mounting apertures 179 which are aligned with arm mount apertures 177 when the arms 178 are slide into their respective mounts 176. A mounting pin 182 is pulled outwardly to allow the arms 178 to be inserted in the mounts 176. Once the arms 178 are in the mounts 176 with their respective mounting apertures 179 and 177 aligned, the pins 182 can be inserted through the mounting apertures to secure the arms 178 in the mounts 176. As is apparent, the shot obstructions 140 are readily interchangeable with obstructions of different sizing and configurations by way of their easy sliding fit into their respective arm mounts 176. In addition, various numbers of obstructions 140 can be utilized such as if less than all the arms 178 were mounted in their mounts 176. One example of a different shot obstruction which can be utilized is the clear obstruction 183 shown in FIG. 15. As can be seen, the shot obstructions 140 have all been removed from their arm mounts 176 with only the clear shot obstruction 182 placed in central arm mount 176*c*. This is of particular value where the training assembly 100 is to be utilized for practicing free throws as with a clear obstruction 182, the player's vision of the basket will not be obstructed as it would be with the shot obstructions 140 having the enlarged mesh portions 180. This, of course, is desirable for free throw practice as with free throws, there are no defenders present. In addition, the shot obstruction 183 can be placed at a desired height over the floor by adjusting the telescoping section 114 accordingly so as to develop an improved arch in a player's free throw shot. Manifestly, a wide variety of other shot obstructions 140 can be created and utilized with the apparatus 100 herein.

In addition to the transverse reciprocating movement of the guarding mechanism 130 indicated by arrows 142, the operator 102 can also pivot the guarding mechanism 130, including the player-engaging portion 132, about the vertical axis 184 of the standard 110. More specifically, the upper mast section 114 includes a side pole 186 attached at its top to the arm mount 176*b* and at its bottom to a lock ring 188. The lock ring 188 is sized to telescope over the lower mast section 112 and bottom stem 116. The lock ring 188 has a friction lock 190 associated therewith similar to the other friction locks so that when the lever thereof is pivoted upward to its unlocked position, the operator 102 can pivot the guarding mechanism 130. In addition, this pivoting action about the axis 184, as indicated by arrows 192, will pivot the upper mast section 114 and its arm mounts 176 and thus any shot obstructions 140 mounted therein. In this manner, the operator 102 can more accurately simulate a defender as the offensive player changes position relative to the basket and in front of the apparatus 100 so that the obstructions 140 and the player-engaging portion 132 can be pivoted to maintain their position between the player 138 and basket. Also, the guarding mechanism 130 and shot obstruction 140 can be pivoted to a desired angular position and locked in place to allow a player 138 to practice shots alone and in an arc about the apparatus 100.

The lower mast section 112 is provided with a guiding bracket 194 near the top thereof for the side pole 186. The pole 186 extends through the guiding bracket 194 and downwardly to a transverse handle 196 near its bottom and the lock ring 188 thereat. When the lever of lock 190 is pivoted downwardly, the ring 188 is locked against the stem 116 preventing the lower mast section 112 from rotating therein. However, once the lock 190 is pivoted upwardly to its unlocked position, the mast 112 can be pivoted along with its bracket 194 which, in turn, will pivot the upper mast section 114 including the attached side rod 186 and lock ring 188.

A friction lock 198 is also provided at the upper end of lower mast section 112 which must be released with the spring pin 128 withdrawn to allow the upper mast section 114 to be moved relative to the lower mast section 112 for vertical adjustment as indicted by arrows 199. The friction lock 198 is provided to supplement and secure the pin lock between the lower and upper mast sections 112 and 114 once the height of the upper mast section 114 over the lower mast section 112 has been determined by releasing the spring pin 128 into one of the aligned holes 126 on the upper mast section 114. This is desirable as repeated high force player impacts may be capable of causing the spring loaded pin 128 to move out of hole 126 into which it is urged. In addition, the lock 198 will bear the load of the weight of the upper mast 114 so it is not all carried by pin 128. This is particularly desirable when the standard 110 is lifted up for disassembly from the mounting stem 116.

To allow the lower mast section 112 to be lifted out of the stem 116 for disassembly of the basketball training assembly 100 herein, the lower friction lock 190 on the lock ring 188 must be released. Preferably, the shot obstructions 140 are removed from their sleeve mounts via pulling of pins 182 to reduce the weight that must be lifted when removing the standard 110 including the upper mast section 114 and lower mast section 112 from the stem 116. Also, the lock 198 should be released and pin 128 pulled allowing the upper mast section 114 to telescope all the way into the lower mast section 112 so that standard 110 is in its most compact form with the lock 198 then being closed to secure the standard together for disassembly of the standard 110. With the shot obstructions 140 removed from their mounts 176, the operator 102 or player 138 can exert an upward force on the transverse handle 196 pushing the lower mast section 112 along with the attached upper mast section 114 out of the stem 116 for transportation to storage. In this manner, the apparatus 100 can be stored in a relatively compact fashion and then can be relatively easily and quickly reassembled by reversing the disassembly steps set forth above.

When the basketball defender apparatus 100 is assembled, it is relatively easily moved about a basketball gym or the like by way of pair of wheels 200 and 202 mounted at the front of the base in spaced relation to the base bottom which rests on the floor by respective mounting brackets 204 and 206. To roll the assembly 100 on a floor surface, the operator 102 or player 138 need merely reach down and grab the handle 208 provided at the rear of the base 104 and tilt the base 104 forwardly to engage the wheels 200 and 202 on the floor surface, whereupon they can then push or pull the apparatus 100 for rolling movement on the floor to a desired location.

While there have been illustrated and described particular embodiments of the present invention, it will be appreciated that numerous changes and modifications will occur to those skilled in the art, and it is intended in the appended claims to cover all those changes and modifications which fall within the true spirit and scope of the present invention.

I claim:

1. An apparatus for simulating a basketball defender, the basketball defender apparatus comprising:

a floor mount for supporting the apparatus on a floor surface;

a standard extending upwardly from the floor mount;

at least one shot obstruction mounted to the vertical standard over which a shot with a basketball can be taken by a player; and a guarding mechanism secured to the standard and having a player engaging portion thereof spaced above the floor mount, the guarding mechanism being movable transversely relative to the standard to adjust the position of the portion in front of the standard and shot obstruction for creating a minimum distance the player must be from the standard when engaged with the guarding mechanism portion.

2. The basketball defender apparatus of claim 1 wherein the guarding mechanism can be moved to position the player engaging portion at a predetermined substantially fixed position in front of the standard.

3. The basketball defender apparatus of claim 1 wherein the guarding mechanism can be selectively moved transversely relative to the standard by an operator to vary the position of the player engaging portion in front of the standard.

4. The basketball defender apparatus of claim 1 including a locking device for the guarding mechanism and which has (1) a locked position wherein movement of the guarding mechanism is prevented with the player engaging portion at a predetermined substantially fixed position in front of the standard, and (2) an unlocked position wherein an operator can selectively move the guarding mechanism transversely to the standard to vary the position of the player engaging portion in front of the standard.

5. The basketball defender apparatus of claim 4 wherein the floor mount includes an upper platform surface behind the standard on which the operator can stand while selectively moving the guarding mechanism with the locking device in its unlocked position.

6. The basketball defender apparatus of claim 1 wherein the standard defines a vertical axis substantially perpendicular to the floor surface and the standard is rotatable about its axis for angular displacement of the player engaging portion about the standard.

7. The basketball defender apparatus of claim 6 wherein the guarding mechanism includes handle controls for allowing an operator to transversely and angularly move the guarding mechanism and player engaging portion.

8. The basketball defender apparatus of claim 7 wherein the shot obstruction is mounted at substantially the top of the standard and rotating the standard about its axis with the controls causes the shot obstruction to rotate therewith.

9. The basketball defender apparatus of claim 1 wherein the at least one shot obstruction comprises first, second and third elongate members extending in different directions from substantially the top of the standard and all being removably mounted to the standard to allow less than all of the obstruction members to be mounted to the standard.

10. A basketball training apparatus comprising:

a base for supporting the apparatus on a floor surface;

a substantially vertical standard;

a carriage mounted to the standard and slidable thereon to a plurality of different vertical positions along the standard; and a guarding mechanism having a player engaging portion in front of the standard and a slidable shaft connected to the player engaging portion and slidable through the carriage for moving the player engaging portion into contact with a player at a variety of different distances from the standard.

11. The basketball training apparatus of claim 10 wherein the player engaging portion extends transversely to the standard and has a cushioned material to allow cushioned impact with a player.

12. The basketball training apparatus of claim 10 wherein the carriage includes bearings for supporting the guarding mechanism shaft for sliding movement therethrough.

13. The basketball training apparatus of claim 12 wherein the bearings comprise a front set of upper and lower rollers and a rear set of upper and lower rollers through which the shaft extends for rolling engagement therewith.

14. A basketball practice apparatus for defending shots taken by a player, the basketball practice apparatus comprising:

a floor mount base for supporting the apparatus;

a vertical standard attached to the base;

a plurality of elongate arms removably mounted substantially at the top of the standard to allow less than all of the arms to be mounted to the standard over which a shot with a basketball can be practiced by a player; and a guarding mechanism distinct from the elongate arms and secured to the standard, the guarding mechanism having a player engaging portion spaced in front of the standard for creating a minimum distance the player must be from the standard when engaged with the player engaging portion.

15. The basketball practice apparatus of claim 14 wherein the guarding mechanism is slidably mounted on the standard to adjust the height of the player engaging portion over the floor mount base to allow the player engaging portion to engage players of different heights at a desired location on the players body.

16. The basketball practice apparatus of claim 14 wherein the plurality of elongate arms each include an enlarged end distal from the standard with two side arms extending upwardly and outwardly from the standard in different directions from each other and a central arm extending substantially straight upward from the standard between the arms.

17. The basketball practice apparatus of claim 16 wherein each of the side arms extend upwardly and outwardly from the standard at the same predetermined angle thereto such that the enlarged ends of the side arms and central arm are at approximately the same height over the standard.

* * * * *